US009361745B2

(12) United States Patent
Abston

(10) Patent No.: US 9,361,745 B2
(45) Date of Patent: Jun. 7, 2016

(54) BAGGED ICE VENDING MACHINE

(71) Applicant: Lester Abston, Fruitland, ID (US)

(72) Inventor: Lester Abston, Fruitland, ID (US)

( * ) Notice: Subject to any disclaimer, the term of this patent is extended or adjusted under 35 U.S.C. 154(b) by 178 days.

(21) Appl. No.: 13/924,561

(22) Filed: Jun. 22, 2013

(65) Prior Publication Data

US 2013/0341344 A1 Dec. 26, 2013

Related U.S. Application Data

(60) Provisional application No. 61/663,167, filed on Jun. 22, 2012.

(51) Int. Cl.

| | |
|---|---|
| ***G07F 11/58*** | (2006.01) |
| ***G07F 9/10*** | (2006.01) |
| ***G07F 17/00*** | (2006.01) |

(52) U.S. Cl.

CPC ..... *G07F 9/105* (2013.01); *G07F 11/58* (2013.01); *G07F 17/0071* (2013.01)

(58) Field of Classification Search

None

See application file for complete search history.

(56) References Cited

U.S. PATENT DOCUMENTS

| | | | | |
|---|---|---|---|---|
| 4,986,441 | A * | 1/1991 | Kanbe et al. | 221/130 |
| 5,210,387 | A * | 5/1993 | Smith et al. | 221/150 HC |
| 6,230,930 | B1 * | 5/2001 | Sorensen et al. | 221/131 |
| 6,357,621 | B1 * | 3/2002 | Guindulain Vidondo | 221/85 |
| 2004/0140317 | A1 * | 7/2004 | Forte | 221/123 |
| 2009/0090735 | A1 * | 4/2009 | Cooper et al. | 221/9 |
| 2012/0004770 | A1 * | 1/2012 | Ooyen et al. | 700/235 |
| 2012/0255967 | A1 * | 10/2012 | Hecht et al. | 221/150 A |

* cited by examiner

*Primary Examiner* — Leslie A Nicholson, III
*Assistant Examiner* — Ayodeji Ojofeitimi
(74) *Attorney, Agent, or Firm* — White-Welker & Welker, LLC; Matthew T. Welker, Esq.

(57) ABSTRACT

A bagged ice vending machine where a drive motor is energized causing conveyors to move, the conveyors are designed to move in opposite directions so that the product will move to the end of that conveyor and drop to the conveyor below, which will force the last bag on the bottom conveyor to fall into the vending chute, activating the ice vended sensor, and slide into the vending hopper, the product can then be accessed by the customer through the vended product access door. A drive chain is configured on each conveyor chain sprocket so that when the drive motor is energized the conveyors will move in opposing directions. This movement indexes the product so that as each item reaches the end of the conveyor it will fall to the conveyor below. Each conveyor will only move the product one position for each product dispense cycle.

10 Claims, 22 Drawing Sheets

150

127

BAGGED ICE VENDING MACHINE

CROSS REFERENCE TO RELATED APPLICATIONS

This application claims priority from U.S. Patent Application Ser. No. 61/663,167, entitled "Stand and drawing-easel attached to a keyboard to use with mobile electronic devices", filed on 22 Jun. 2012. The benefit under 35 USC §119e of the United States provisional application is hereby claimed, and the aforementioned application is hereby incorporated herein by reference.

FEDERALLY SPONSORED RESEARCH

Not Applicable

SEQUENCE LISTING OR PROGRAM

Not Applicable

TECHNICAL FIELD OF THE INVENTION

The present invention relates generally to vending machines. More specifically, the present invention relates to vending machines for pre-packaged products such as bagged ice.

BACKGROUND OF THE INVENTION

The self-service ice industry is one of the fastest growing business opportunities available today. Typically, large vending machines are used that manufacture, store, bag, and dispense purified ice in bags. The downside of these machines is cost and location, which requires water for the manufacturing component of such machines.

Other pre-packaged vending machines are known in the art, but are limited due to the size and weight of prepackaged ice, which is often sold in bags ranging in weight from 5 to 20 lbs. Current vending machines know in the art are not capable of dispensing multiple sized pre-packed ice bags, or are not capable of being adapted to vending a product the size and weight of a desired bag of ice by the average consumer.

Stores typically have one or more large coolers located either within or outside of a store for selling one or more sizes of prepackage ice bags. These coolers are inefficient for both sellers and buyers. An externally located cooler requires a lock and employee to manual dispense purchased product, or the often abused "honor system" of a buyer after the purchase has been made in the store. Interior coolers are just as inefficient, as they are typically not located near a register, again requiring an employee or the honor system to be used after payment, or a consumer to stack or carry one or more bags in a cart to check out, as the product melts potentially making a mess in the store, and lost value to the buyer.

The object of the present invention is to improve and simplify the construction and operation of such machines.

Another object of the invention is to provide an ice vending machine that easily and quickly dispense desired product, is easy to replenish, has a low manufacturing cost, and high profitability offering a better seller and buyer experience for the purchase of the product.

SUMMARY OF THE INVENTION

The bagged ice vending machine consists of a refrigerated cabinet with the front of the cabinet being an access door for servicing the bagged ice vending machine, money receiver/exchanger plus control electronics, vended product access door. The front panel or door of the bagged ice vending machine is opened to allow the pre-packaged ice to be loaded on the conveyor belts as needed.

To dispense product, money is deposited into the money receiver, the drive motor is then energized causing the conveyors to move, the conveyors are designed to move in opposite directions so that the product will move to the end of that conveyor and drop to the conveyor below, which will force the last bag on the bottom conveyor to fall into the vending chute, activating the ice vended sensor, and slide into the vending hopper, the product can then be accessed by the customer through the vended product access door. The drive motor will remain energized until the product present sensor is satisfied, if the product present sensor is not satisfied after a predetermined amount of time the drive motor will de-energize and the machine will go into an out of ice condition illuminating the out of ice indicator on the money receiver.

A drive chain is configured on each conveyor chain sprocket so that when the drive motor is energized the conveyors will move in opposing directions. This movement indexes the product so that as each item reaches the end of the conveyor it will fall to the conveyor below. Each conveyor will only move the product one position for each product dispense cycle. This process will continue for each dispense cycle until all the product has been dispensed and the ice present sensor no longer sees any product.

BRIEF DESCRIPTION OF THE DRAWINGS

The accompanying drawings, which are incorporated herein an form a part of the specification, illustrate the present invention and, together with the description, further serve to explain the principles of the invention and to enable a person skilled in the pertinent art to make and use the invention.

DETAILED DESCRIPTION OF THE INVENTION

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention. Referring to the figures, it is possible to see the various major elements constituting the apparatus of the present invention.

Figure 1:
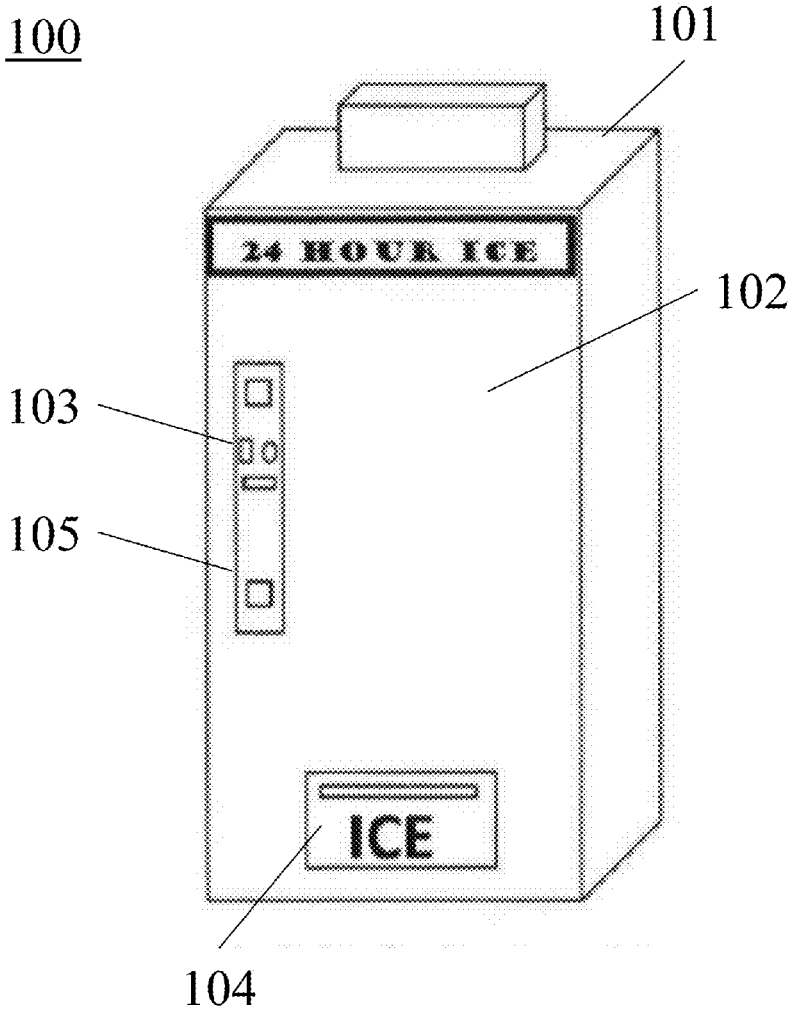
FIG. 1 is an external perspective view of a single mechanism bagged ice vending machine taught by the present invention.
Figure 2:
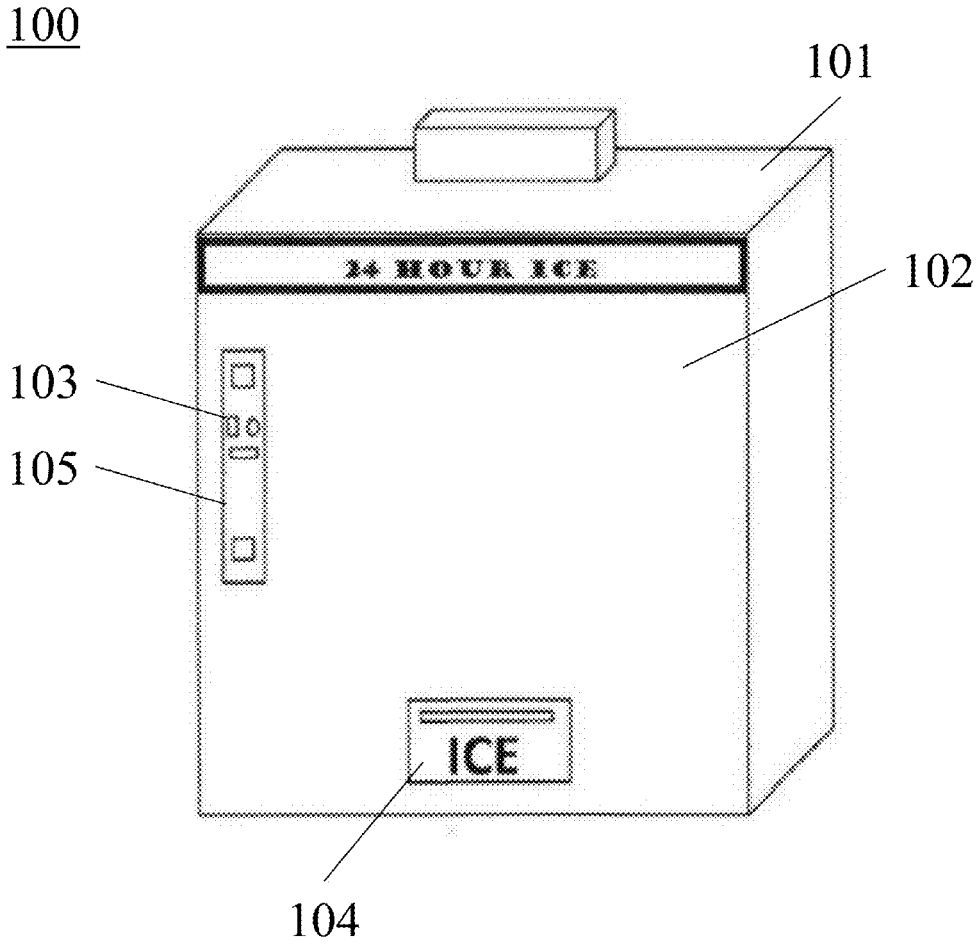
FIG. 2 is an external perspective view of a double mechanism bagged ice vending machine taught by the present invention.
Figure 3:
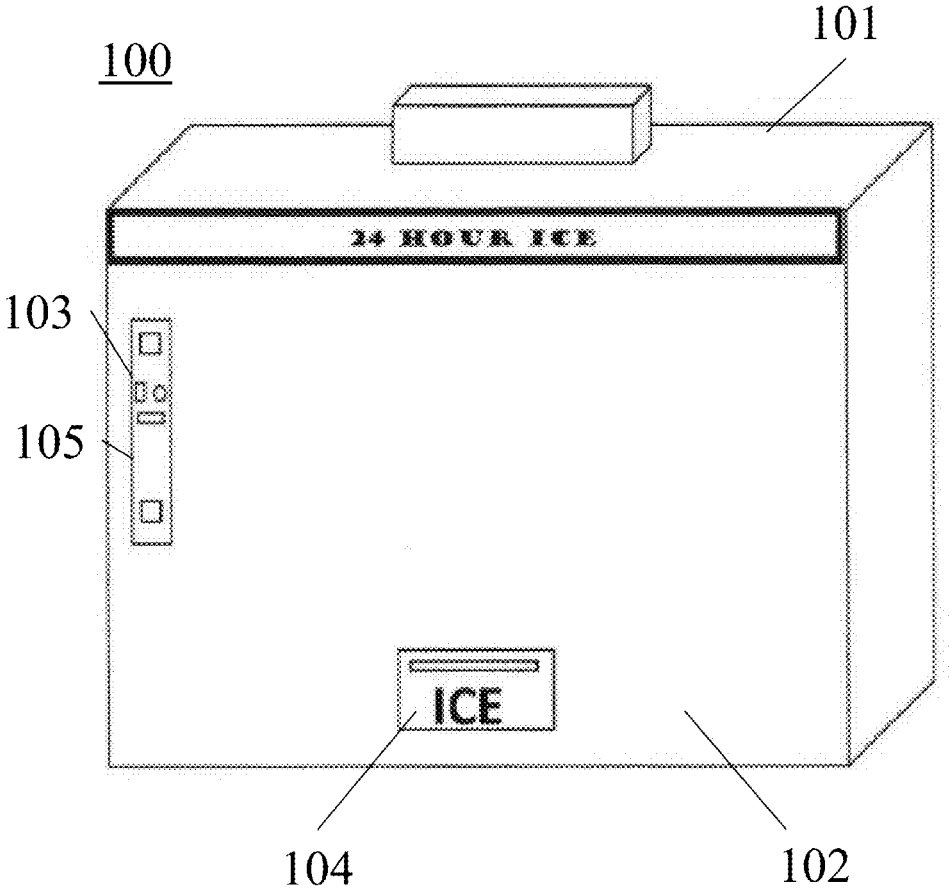
FIG. 3 is an external perspective view of a triple mechanism bagged ice vending machine taught by the present invention.

Now referring to the Figures, the embodiment of the physical description, the bagged ice vending machine 100 consists of the following elements: a refrigerated cabinet 101 with the front of the cabinet 102 being an access door for servicing the bagged ice vending machine 100, money receiver/exchanger 103 plus control electronics 105, vended product access door 104 as shown in FIGS. 1-3.

Figure 4:
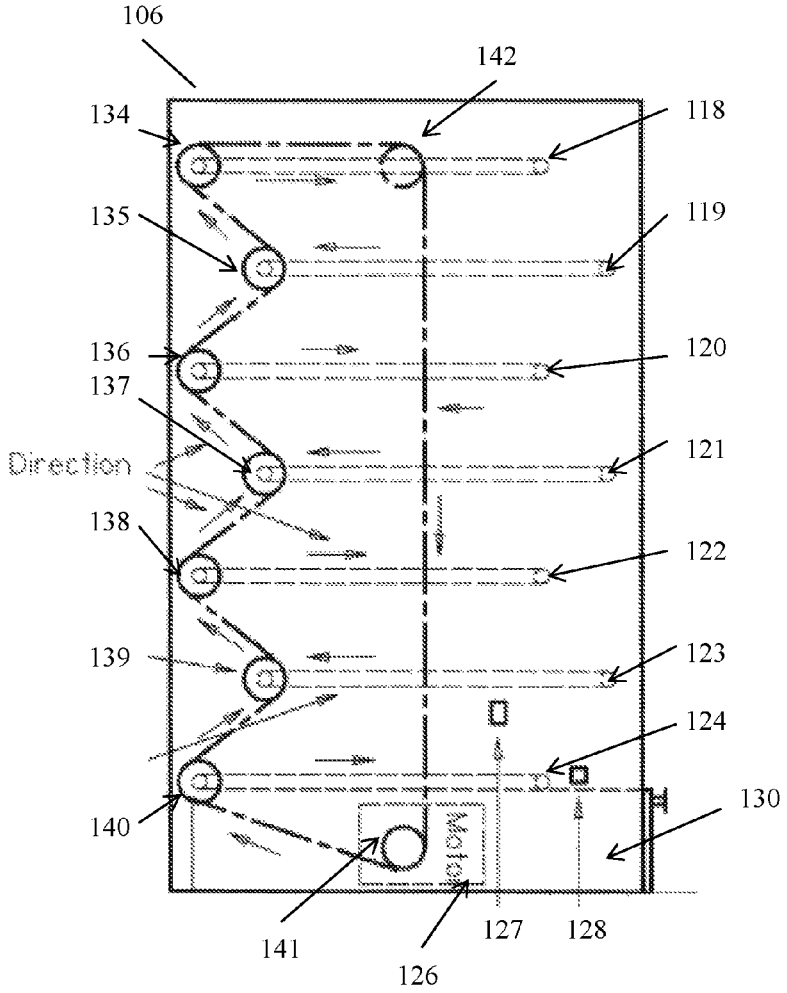
FIGS. 4-5 illustrate the internal mechanism of the vending machine of the present invention.

The vending mechanism 106, as shown in FIG. 4, located in the interior of the bagged ice vending machine consists of side mounting plates 107, belt conveyors 108, sprockets 109-117 for each conveyor belt 118-124, a chain 125 and drive motor 126, a product present sensor 127, a product vended sensor 128, a vending chute 129, and a hopper 130. Each bagged ice vending machine can contain more than one vending mechanism 106 for increased capacity.

Figure 10:
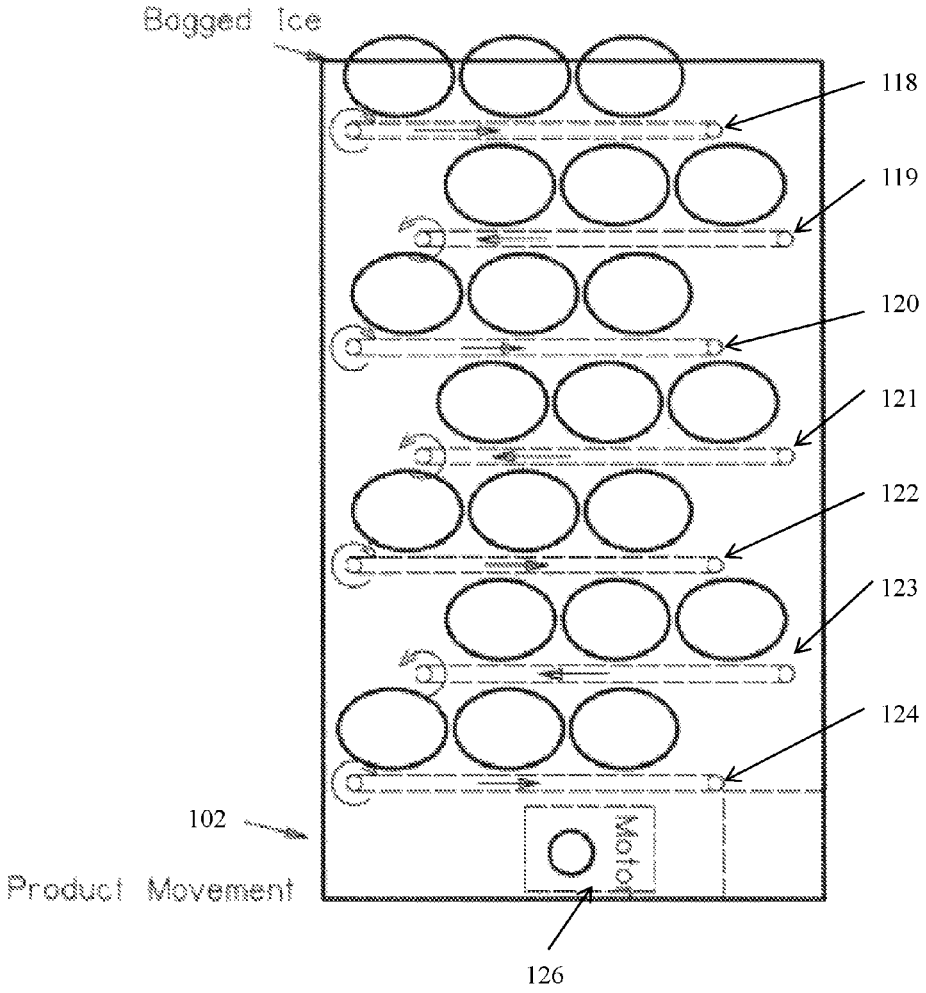
FIG. 10 illustrates the product movement of bagged ice along the internal mechanism of the present invention.
Figure 11:
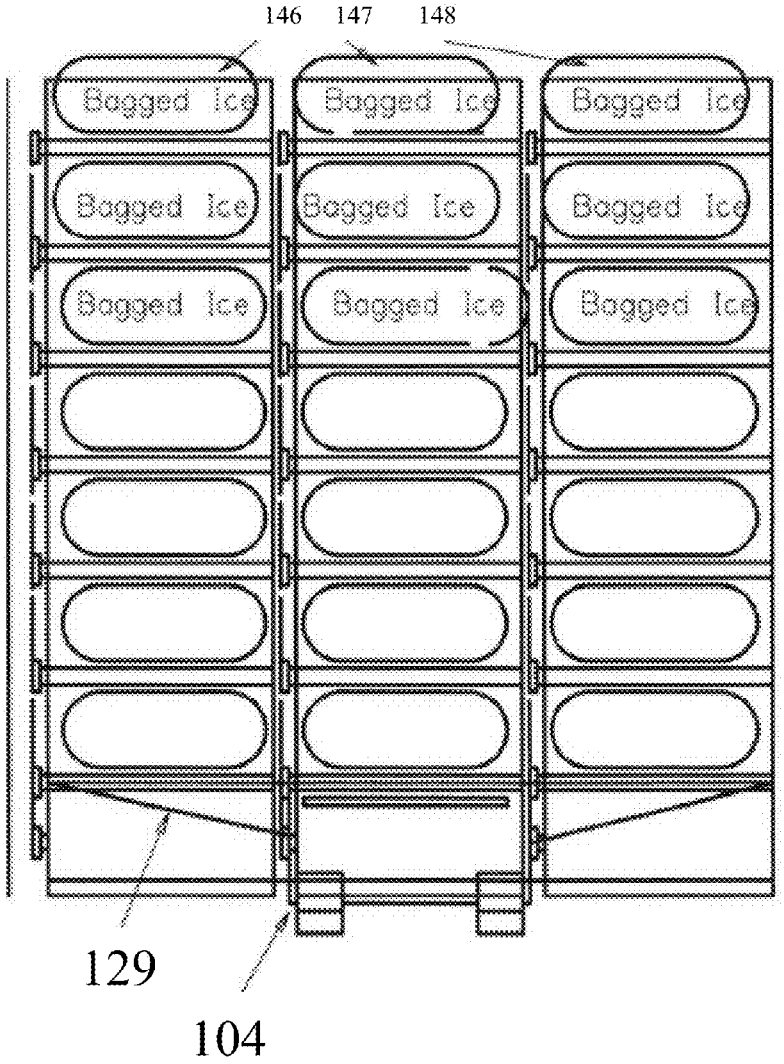
FIG. 11 illustrates the vending machine loaded with bagged ice and the chute, hopper, and door components of the internal vending mechanism of the present invention.

The front panel or door 104 of the bagged ice vending machine is opened by pulling on a handle 150 and rotating the door along a hinge 160 to allow the pre-packaged ice to be loaded on the conveyor belts 118-124 as needed as shown in FIGS. 10-11. The door 102 is closed and secured and the bagged ice vending machine 100 is ready for service.

Figure 12:
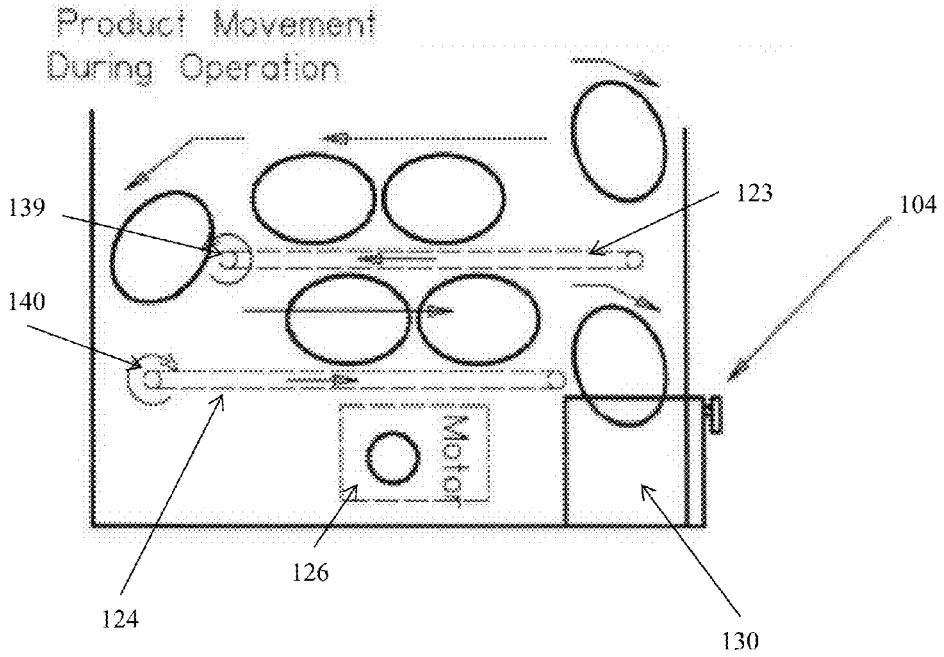
FIG. 12 illustrates the product movement of bagged ice along the internal mechanism toward the vending hopper and door of the present invention.
Figure 13:
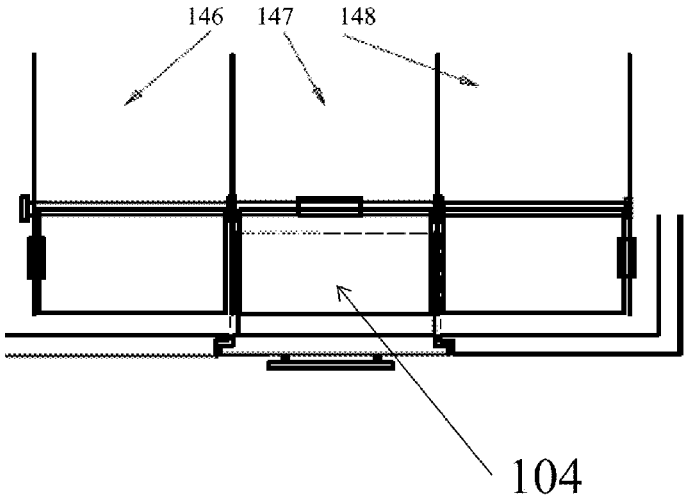
FIGS. 13-16 illustrate the dispensing mechanism of the vending machine of the present invention.
Figure 14:
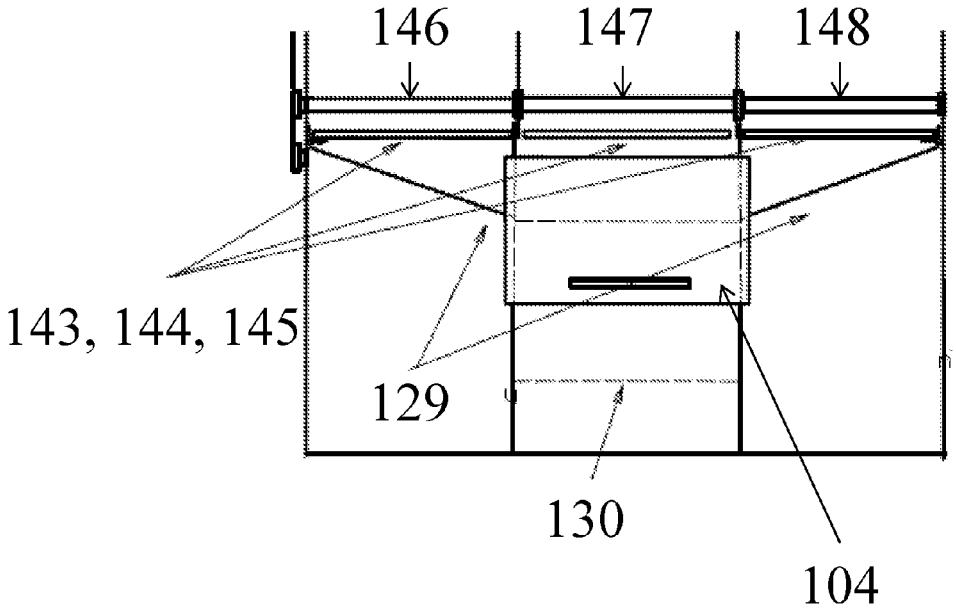

As shown in FIGS. 10-12, to dispense product, if the vending machine is in a "ready to dispense" mode, the appropriate amount of is deposited into the money receiver 103, a control unit 105 polls the "ice present" sensors 127, if ice is present than the ice dispense solenoid 2001 on one of the output plates 143-145 (one that was positive for ice) is energized causing the ice to be dispensed.

When a bag of ice is dispensed the output plate 143-145 drops toward the ice dispense vending hopper 129 causing the bag of ice to enter the vending hopper 127 and energizing vending door solenoid 2001. The customer can then open the vending bin door 104 and take the ice. The control unit 105 polls the "ice present" sensors 127, if no ice is present then the drive motor 126 is energized causing the conveyors 118-124 to move until the product present sensor 127 is satisfied, if the product present sensor 127 is not satisfied after a predetermined amount of time the drive motor 126 will de-energize and the machine will go into an out of ice condition illuminating the "out of ice" indicator on the money receiver 103 and will be inoperable until there vending machine is reloaded.

When the drive motor 126 is then energized causing the conveyors belts 118-124 to move, the conveyors belts 118-124 are designed to move in opposite directions so that the product will move to the end of that conveyor and drop to the conveyor below, which will force the last bag on the bottom conveyor 124 to fall into the vending chute 129, activating the ice vended sensor 127, and slide into the vending hopper 130, the product can then be accessed by the customer through the vended product access door 104. The drive motor 126 will remain energized until the product present sensor 127 is satisfied, if the product present sensor 127 is not satisfied after a predetermined amount of time the drive motor 126 will de-energize and the machine 100 will go into an out of ice condition illuminating the out of ice indicator on the money receiver 103.

If a bagged ice vending machine 100 consists of more than one vending mechanism 131-133, then instead of going immediately into the out of ice state, the bagged ice vending machine 130 will look at the next vending mechanisms 132-133 ice present sensor, if it is satisfied the bagged ice vending machine 100 will go into a ready to vending state. This process will be repeated for all vending mechanisms 131-133 until it is determined whether there is any remaining product to be dispensed, if no ice is seen then bagged ice vending machine will go into an out of ice state and will not be operational until reloaded.

As shown in FIGS. 4, 10, and 12, the drive chain 126 is configured on each conveyor chain sprockets 134-142 so that when the drive motor 126 is energized the conveyors 118-124 will move in opposing directions as shown by the arrows. This movement indexes the product so that as each item reaches the end of the conveyor it will fall to the conveyor below. Each conveyor 118-124 will only move the product one position for each product dispense cycle. This process will continue for each dispense cycle until all the product has been dispensed and the ice present sensor 127 no longer sees any product.

Figure 5:
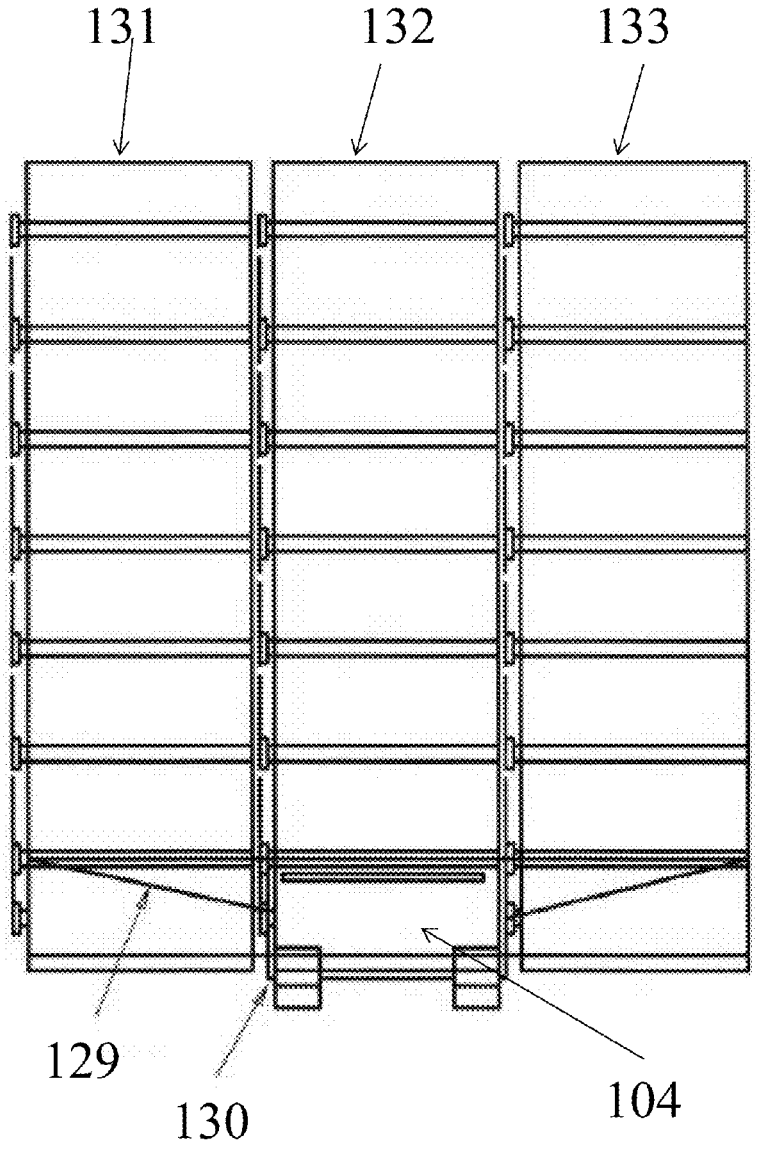
Figure 7:
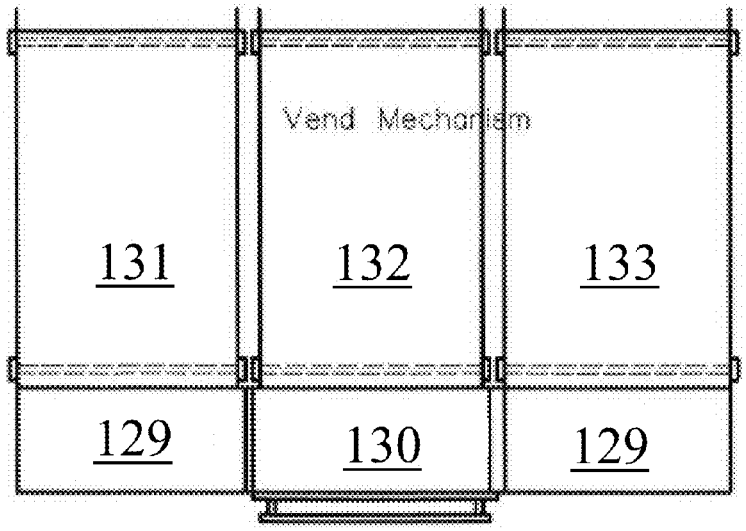
FIG. 7 illustrates the vending mechanism, chute, and drawer of the present invention.
Figure 8:
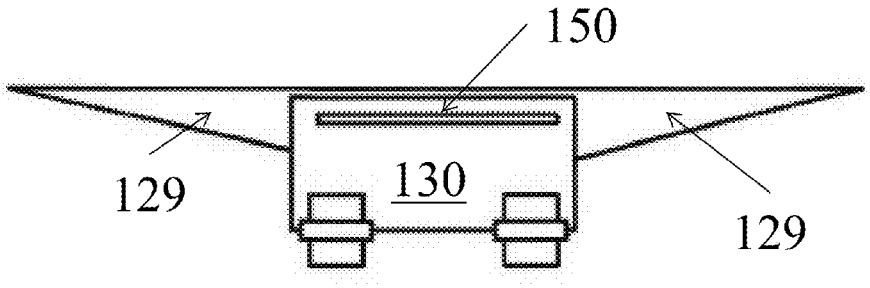
FIGS. 8-9 illustrate the vending chute and drawer of the present invention.
Figure 9:
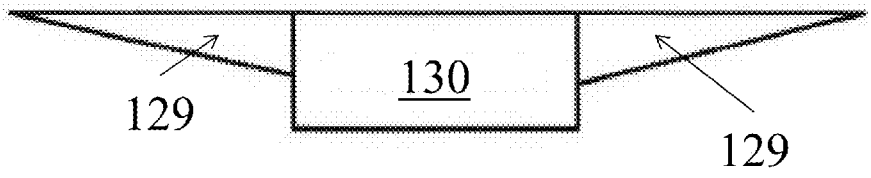

There will be only one drive motor 126 to run the three sets of conveyors in a multiple conveyor mechanism embodiment where three vending mechanisms 131-133 are utilized as shown in FIGS. 5 and 7. There could be more or less conveyors to reduce or extend the amount of ice to be available to be vended. But most machines, in a preferred embodiment, will have three sets of conveyors.

Figure 18:
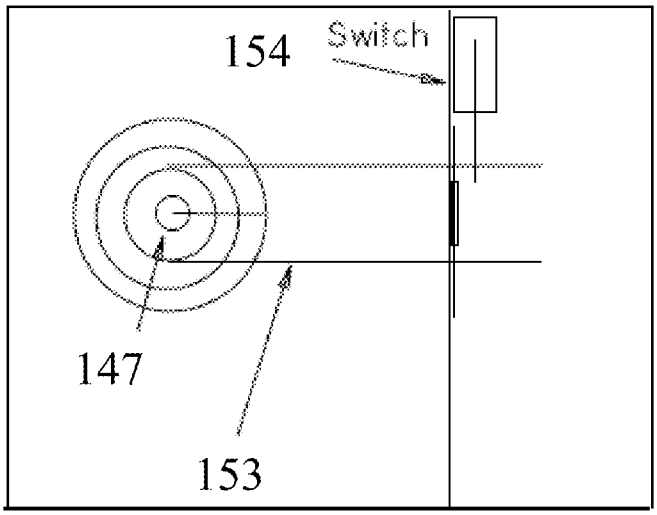
FIGS. 18-19 illustrate the dispensing door of the vending machine of the present invention.
Figure 19:
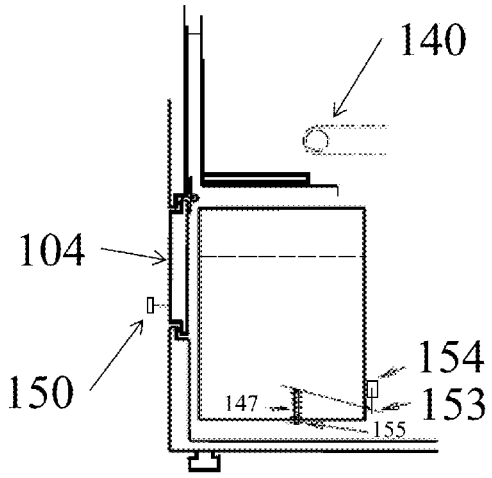

Referring to FIGS. 13-22, there is an output plate 143-145 at the end of the bottom of each conveyor set 146-148. This is where the bag of ice will fall to as it is staged for vending. Each output plate 143-145 is hinged 146 with spring return 147 and an integral ice present sensor 127 to tell the controls that a bag of ice is present. Each output plate 143-145 will have a solenoid 152 that is energized by the controls 105 to allow the bag of ice to be vended if it is sensed by an ice present sensor 127 that a bag is on the output plate 143-145 as shown in FIGS. 17*a*-17*c* The ice present sensor 127 assembly is shown in FIGS. 18-19 and is comprised of a spring return 147 held in place by a retainer clip 155 connected to an actuator arm 153 attached to a snap switch 154.

Figure 6:
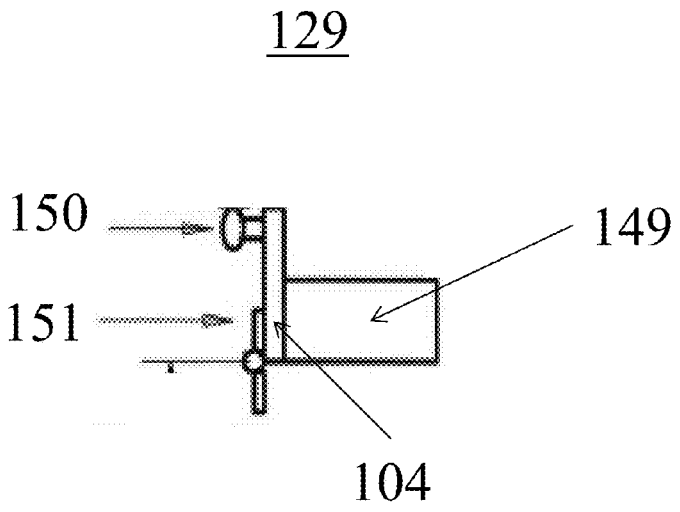
FIG. 6 illustrates the hopper of the vending machine of the present invention.
Figure 15:
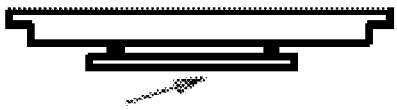
Figure 16:
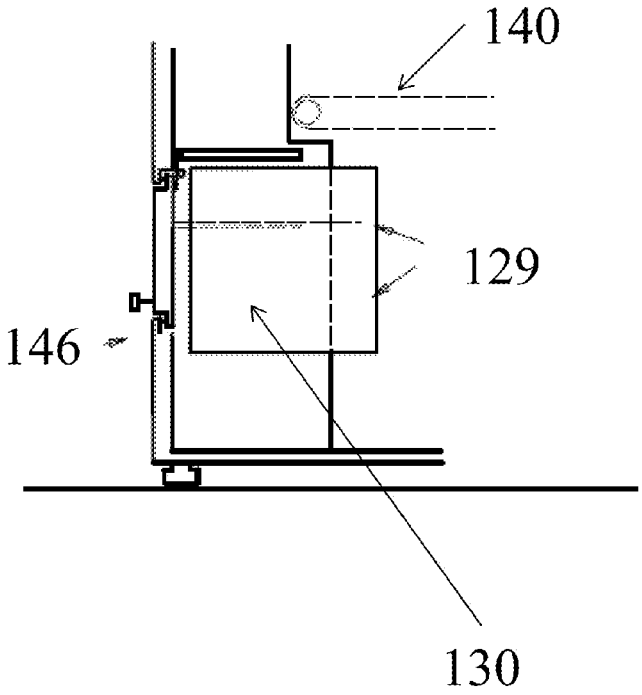
Figure 17A:
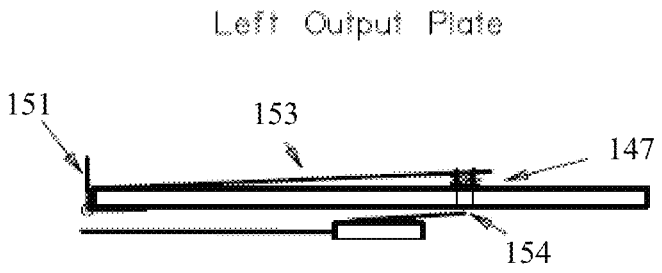
FIGS. 17*a*-17*c* illustrate the output plate of the dispensing mechanism of the vending machine of the present invention.
Figure 17B:
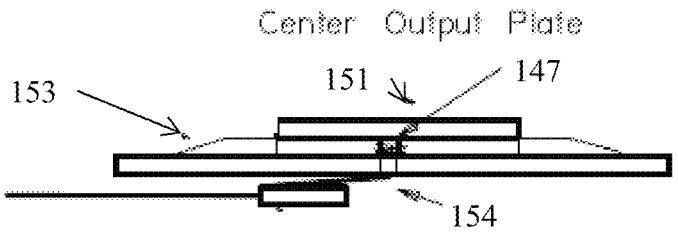
Figure 17C:
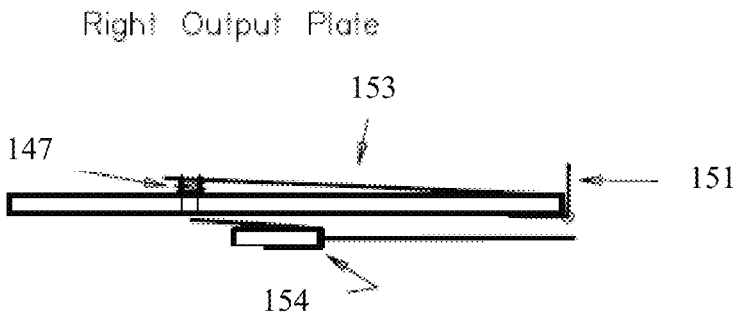

Referring to FIGS. 6, 8-9, 11, 13, and 15 the vending hopper 130 is shown as comprised of a drawer 149 connected to the dispensing door 104 which has a handle 150 and hinge 151 as show in FIGS. 6-7 and 15. Depending on the embodiment, one or more vending chutes 129 lead from the last belt 140 to the vending hopper 30 as show in FIGS. 8-9.

Figure 20:
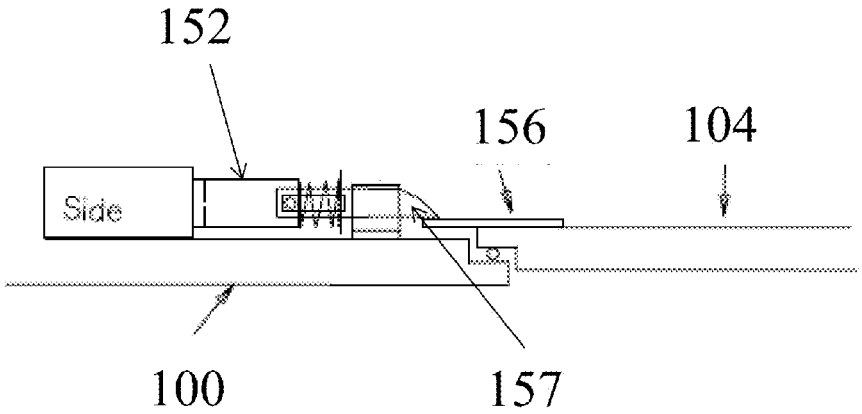
FIGS. 20-22 illustrate the dispensing door solenoid of the vending machine of the present invention.
Figure 21:
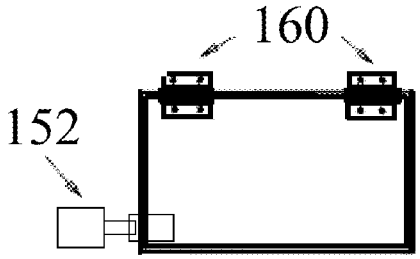
Figure 22:
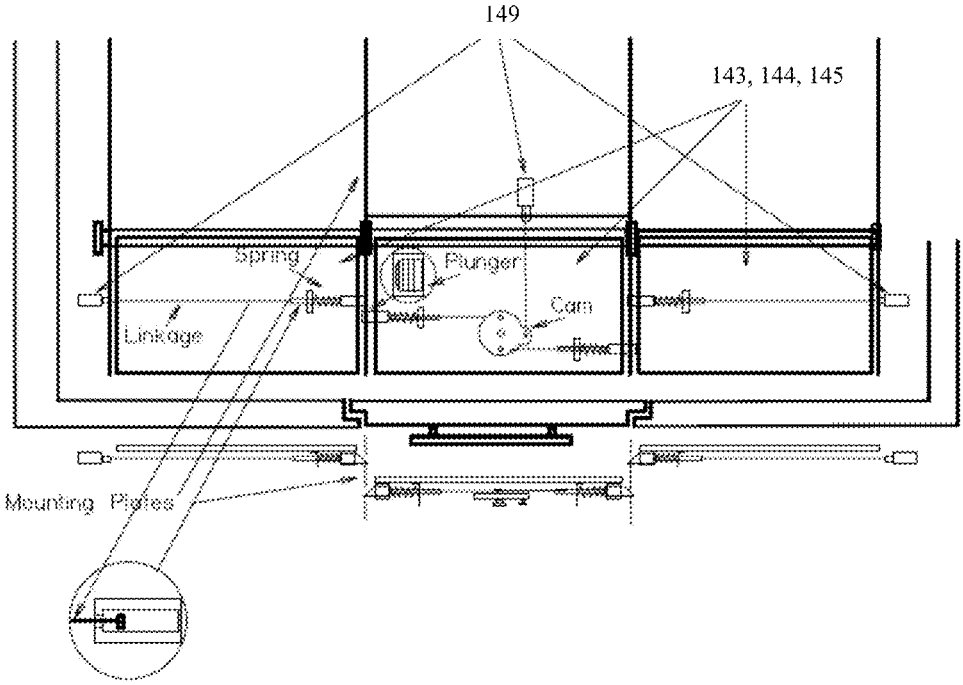

FIGS. 20-22 illustrates the door solenoid, where the solenoid 152 is attached to the frame of the vending machine and extends and retracts a plunger 157 to engage a striker 156 affixed to the door 104, which locks the door 104 in a closed position.

In one embodiment, the vending door 104 will have a solenoid 2101 the enable/disable its opening depending on if there is ice available. Also when disabled the solenoid 152 will prevent the door 104 from being opened and causing a cooling issue or vandalism.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. A bagged ice vending machine comprising:

a refrigerated cabinet with the front of the cabinet being an access door for servicing the bagged ice vending machine;

a refrigerated cabinet;

the front of the cabinet serving as an access door for servicing the bagged ice vending machine;

an electronics control unit;

a money receiver/exchanger;

a vended product access door;

one or more internal vending mechanisms consisting of:

side mounting plates;

one or more belt conveyors;

sprockets for each conveyor;

a chain connecting each sprocket in a loop;

a drive motor for moving the chain in a looping motion;

a product present sensor;

a product vended sensor;

a vending chute; and a hopper;

an output plate at the end of the bottom of each conveyor set;

the output plate is hinged with spring return and an integral ice present sensor to tell the controls that a bag of ice is present;

each output plate has a solenoid that is energized by the controls to allow the bag of ice to be vended if it is sensed by an ice present sensor that a bag is on the output plate;

when the drive motor is then energized causing the conveyors belts to move;

the conveyors belts are designed to move in opposite directions so that the product will move to the end of that conveyor and drop to the conveyor below, which will force the last bag on the bottom conveyor to fall into the vending chute;

activating the ice vended sensor;

sliding the bag of ice into the vending hopper;

accessing the product can then be accessed through the vended product access door;

the drive motor remains energized until the product present sensor is satisfied; and if the product present sensor is not satisfied after a predetermined amount of time the drive motor will de-energize and the machine will go into an out of ice condition illuminating the out of ice indicator on the money receiver.

2. The bagged ice vending machine of claim 1, wherein if the bagged ice vending machine consists of more than one vending mechanism, then instead of going immediately into the out of ice state, the bagged ice vending machine will look at the next vending mechanisms ice present sensor;

if it is satisfied the bagged ice vending machine will go into a ready to vending state; and repeating this process for all vending mechanisms until it is determined whether there is any remaining product to be dispensed, if no ice is seen then bagged ice vending machine will go into an out of ice state and will not be operational until reloaded.

3. The bagged ice vending machine of claim 1, wherein the drive chain is configured on each conveyor chain sprockets so that when the drive motor is energized the conveyors will move in opposing directions as shown by the arrows;

this movement indexes the product so that as each item reaches the end of the conveyor it will fall to the conveyor below;

each conveyor only moves the product one position for each product dispense cycle; and this process will continue for each dispense cycle until all the product has been dispensed and the ice present sensor no longer sees any product.

4. The bagged ice vending machine of claim 1, further comprising a multiple conveyor mechanism embodiment where three vending mechanisms are utilized; and there is only one drive motor to run the three sets of conveyors.

5. The bagged ice vending machine of claim 1, wherein the ice present sensor is comprised of a spring return held in place by a retainer clip connected to an actuator arm attached to a snap switch.

6. The bagged ice vending machine of claim 1, further comprising a drawer connected to the dispensing door which has a handle and hinge;

one or more vending chutes lead from the last belt to the vending hopper;

a door solenoid is attached to the frame of the vending machine and extends and retracts a plunger to engage a striker affixed to the door, which locks the door in a closed position.

7. The bagged ice vending machine of claim 6, wherein the vending door solenoid is enabled/disabled depending on if there is ice available based on the ice present sensor.

8. The bagged ice vending machine of claim 1, wherein the front panel or door of the bagged ice vending machine is opened by pulling on a handle and rotating the door along a hinge to allow the pre-packaged ice to be loaded on the conveyor belts.

9. The bagged ice vending machine of claim 1, wherein to dispense product, if the vending machine is in a "ready to dispense" mode, the appropriate amount of is deposited into the money receiver;

the control unit polls the ice present sensors;

if ice is present then an ice dispense solenoid on one of the output plates is energized causing the ice to be dispensed.

10. The bagged ice vending machine of claim 1, wherein when a bag of ice is dispensed the output plate drops toward the ice dispense vending hopper;

the bag of ice enters the vending hopper;

a vending door solenoid is energized; and the vending bin door can be opened to remove the ice.

* * * * *